US005330377A

United States Patent [19]

Kernek

[11] Patent Number: 5,330,377

[45] Date of Patent: Jul. 19, 1994

[54] MULTI-LEVEL SWIM FIN

[76] Inventor: Gregory P. Kernek, 236 Royal Oaks, Huntsville, Tex. 77340

[21] Appl. No.: 14,824

[22] Filed: Feb. 2, 1993

[51] Int. Cl.[5] ..... A63B 31/11

[52] U.S. Cl. ..... 441/64

[58] Field of Search ..... 441/61-64

[56] References Cited

U.S. PATENT DOCUMENTS 3,183,529 5/1965 Beuchat ..... 441/64

4,737,127 4/1988 Lamont ..... 441/64

*Primary Examiner*—Jesus D. Sotelo

*Attorney, Agent, or Firm*—Bush, Moseley & Riddle

[57] ABSTRACT

A swim fin having a shoe and an integrally connected bi-level, relatively short fin assembly. The fin assembly includes upper and lower levels connected by side walls. Automatic valve flaps are provided at the outer portions of baffles and pivot about transverse axes. The valves automatically open and close during the kick to change the apparent area of the assembly. The bi-level arrangement increases the overall efficiency of the swim fin during use.

9 Claims, 1 Drawing Sheet

MULTI-LEVEL SWIM FIN

FIELD OF THE INVENTION

This invention relates generally to swim fins worn on the feet of a swimmer, and particularly to swim fins used underwater in scuba diving or the like, and having a relatively short, bi-level arrangement integrally attached at the toe of a shoe.

BACKGROUND OF THE INVENTION

Heretofore, various types of swim fins have been provided to propel a swimmer underwater with increased speed. One type of swim fin angles the flipper part thereof downwardly relative to the longitudinal axis of the foot in order to take into consideration the posture and leg movements of the human body while swimming, and the direction of intended movement. It can be recognized that a swimmer has much less muscular power to apply during the upstroke portion of each cycle than during the downstroke. In view of such lesser power, the swim fin operates better when it includes normally open vents which are closed during each upstroke to increase the apparent area of the fin. This increase in area provides some decrease in the effort that is exerted by the swimmer to move forward through the water. However turbulent flow of water through such vents can increase the effort required on the downstroke considerably.

A related patent is U.S. Pat. No. 4,627,820 issued Dec. 9, 1986 to Penebre (U.S. Class 441/64) which discloses a swim fin having upper and lower rounded shells that surround a water flow area, and an outwardly extending web or flipper having about the same length as the shells. The flipper is attached centrally near the front ends of the shells, so that the shells together with the fin provide a considerably elongated construction. Check valves in the form of flaps or baffles operate alternately during the power and return kick strokes to increase the propulsion forces. However swim fins disclosed in this patent are quite long due to the fact that the valve assembly is located well to the rear of the fin itself, which is believed to reduce the overall efficiency as compared to the present invention. Moreover the swim fin disclosed in the '820 patent does not provide a structure in which the flexibility of the fin is increased in the toe region. The Lamont U.S. Pat. No. 4,775,343 issued Oct. 4, 1988 (U.S. Class 441/64) shows upper and lower slots providing a flexible fin, however this swim fin also is quite lengthy, which is believed to reduce efficiency.

A general object of the invention is to provide a new and improved swim fin assembly having a multi-level, relatively short construction which increases the efficiency and mobility with which a swimmer can move through the water.

Another object of this invention is to provide a swim fin of the type described which has upper and lower, relatively short fins, and check valve means associated with each fin for controlling the flow of water therepast in a manner that increases the overall efficiency of the fin assembly.

SUMMARY OF THE INVENTION

In accordance with the present invention, each one of a pair of underwater swim fin assemblies includes a shoe portion that is integrally but somewhat flexibly connected to a relatively short fin assembly having upper and lower members. The lower fin member preferably is attached near the toe portion of the shoe, and the upper fin member is integrally connected to the lower fin member by relatively thin vertical side walls to provide a "bi-wing" construction. Flexible blade members below the upper and lower fins provide automatic check valve means in the form of flaps which overlap a rear portion of each fin and which are normally open by virtue of being vertically spaced therefrom. The flaps flex closed during each upstroke to increase the apparent area of the fin assembly, and open during each downstroke. The multi-level, relatively short construction of the present invention enhances efficiency by reason of the fact that the distance between the ball of the swimmer's foot and the geometrical center of the fin assembly is reduced to provide a lesser moment arm centered at the ball of the foot and about which various body muscles work to produce forward thrust.

It will be recognized that during the downward or thrust portion of each kick cycle, relatively high pressure differentials are generated across the "apparent" areas presented by the rearwardly facing walls of the fin. Of course the apparent area of a fin is a transverse cross-sectional area which is perpendicular to the direction of movement. Both the upward and downward strokes cause a certain amount of flexing of the fin, particularly at the connection of the fin portion to the foot piece. During the upward stroke, relatively little effective work is done. The edge surfaces of the fin members are smooth and relatively narrow, resembling an air foil, so that frictional drag is minimized.

DETAILED DESCRIPTION OF A PREFERRED EMBODIMENT

Figure 1:
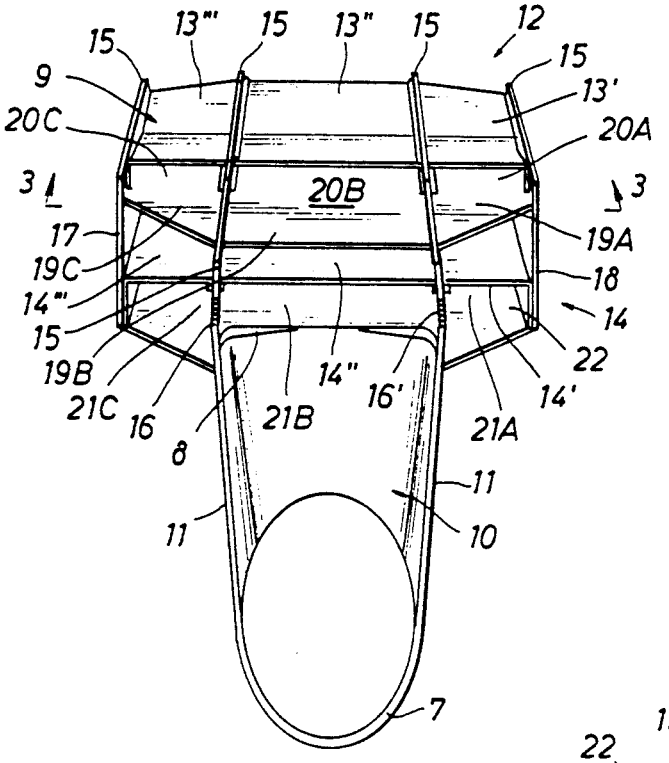
FIG. 1 is a rear perspective view of a swim fin assembly in accordance with the present invention.
Figure 2:
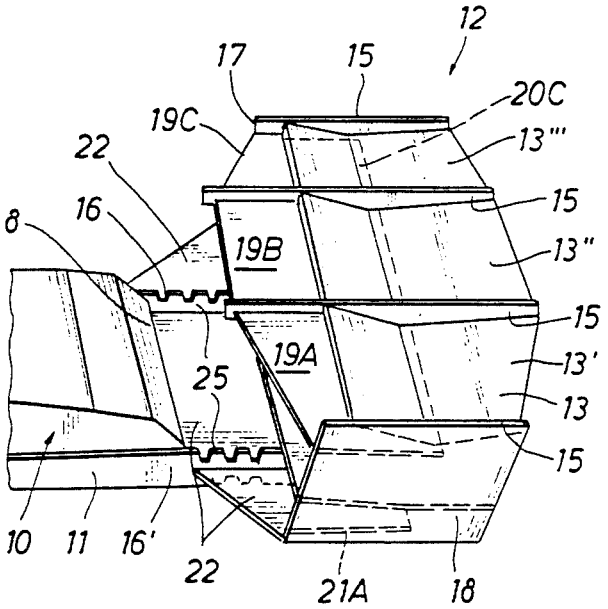
FIG. 2 is a side perspective view of the swim fin assembly shown in FIG. 1.

With reference to FIG. 1, a swim fin assembly 12 in accordance with this invention includes a shoe or foot portion 10 which is made, for example, of a synthetic rubber thick shoe having a multi-level fin indicated generally at 9 attached to the front or toe portion 8 thereof. As used herein, the terms "front", "rear", "upper" and "lower" are used as if the swimmer who is wearing the fin assembly 12 is standing on the ground. The terms "upward" and "downward" are typically used in connection with underwater swimming movements involved in a flutter-type kick. The shoe 10 has side members 11 bonded to its lower opposite sides, and the side members each extend forward and are integral with the lower stiffener ribs 16 and 16' as shown in FIG. 2. The shoe 10 can have a closed heel portion 7, or a suitable strap can be provided on the back of the shoe which fits about the heel of a swimmer to releasably secure the shoe to the foot. Where a strap is used, it can be adjusted in the usual manner.

Figure 3:
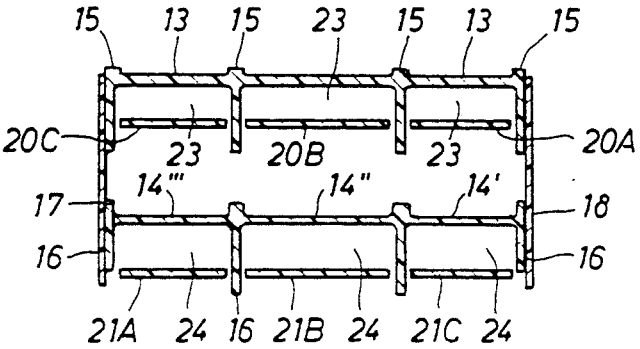
FIG. 3 is a section taken generally along line 3—3 of FIG. 1.

The fin assembly 9, which has a multi-level, relatively short and compact construction, includes an upper fin 13 and a lower fin 14 that are vertically spaced. As shown in FIG. 2, the upper fin 13 has three relatively large plates 13', 13'', 13''' which extend transversely between longitudinally extending stiffener ribs 15. The outer side surfaces of the outermost ribs 15 are secured respectively to the upper edges of relatively thin but rigid side walls 17, 18. Although continuous side walls 17, 18 are shown in the drawings, pairs of spaced forward and rearward walls can be used on each side. Generally rectangularly shaped valve members 20A–C form the front portions of baffle or plate members 19A–C which are secured between opposed sides of pairs of the stiffener ribs 15. The rear of each of the valve members 20A–C is flexibly connected to a respective plate. However the valve members are not connected on either side as shown in FIG. 3, and thus extend forward in a cantilever fashion. Each valve member may be considered to be hinged to the front edges of a plate, so that pivotal rotation can occur about such hinge. When the fin assembly 12 is moved downward in the water to produce forward thrust, flow is established through each of the tunnels 23 via entry ports adjacent the toe 8 of the shoe 10 and each of the valve flaps 20A–C remains substantially parallel to the fins 13'–13'''. On the other hand when the fin assembly 12 is pivoted upward against the resistance of the water, the valve members 20A–C are subjected to pressure differentials and close off the tunnels 23 to water flow. This provides maximum apparent area by which the swimmer can thrust forward.

As shown in FIG. 2, the fixed rear portions of the baffle members 19A–C extend rearward of the fin 13 and toward the shoe 10 a substantial distance. Such portions function to guide the flow of water into the tunnels 23 and past the valve members 20A–20C without any significant turbulence. The flexible valve members or flaps 20A–C extend forward to where their front edges are located at about the longitudinal centers of the fins 13. These members 20A–C open the flow channels 23 during the downstroke for two stage propulsion, but close the flow channels almost completely during the upstroke to achieve single-stage propulsion. As shown, the individual fins 13'–13''' can be constructed such that their rear portions slope downward and forward to a line where the front edges of the valve members 20A–C close against their lower surfaces. From there their forward portions extend directly outward.

The lower level 14 of the multi-level fin assembly 12 is constructed substantially the same as the upper assembly 19, except that the center pair of stiffener ribs 16 are connected to the side members 11 of the shoe 10 as previously described. The lower fins 14', 14'', 14''' extend between adjacent pairs of the lower stiffener ribs 16. The lower flexible check valve members or flaps 21A–C are formed as forward portions of each of the baffles or plates 22. A pressure differential across each of the members 21A–C, which is developed when the fin assembly 12 is thrust upward, forces the front edge of each flap closed against respective lower surfaces of the fins 14'–14'''. A limited amount of flexure of the lower stiffener ribs 16, 16' is permitted by the formation of upper and lower notches 25 which reduces the cross-sectional areas of the ribs between each set of notches.

OPERATION

The fin assemblies are made as shown in the drawings, and an assembly of a bi-level fin and shoe are put on each foot of the swimmer in preparation for an underwater event such as scuba diving.

During each upward stroke of a fin, the upper and lower valve flaps 20A–C and 21A–C automatically are flexed to their closed positions against the lower walls of the respective fins 13, 14, substantially at the beginning of such stroke. Closure provides a somewhat increased apparent area of the fins which correspondingly increases efficiency. In the downward stroke the flaps 20A–C and 21A–C automatically open up to permit water to flow freely through the upper and lower sets of channels 23, 24. This reduces the apparent area of each fin assembly to some extent, and also reduces drag. The multi-level, compact construction of the present invention minimizes the length of the moment arm or distance between the geometrical center of the fin assembly 12 and the ball of the user's foot, which decreases the amount of torque that must be produced about such ball by the swimmer's muscles to achieve a given thrust force in the forward direction. This achieves a substantial overall increase in efficiency as the swimmer moves underwater.

Various materials may be utilized for the swim fin of the present invention. Preferably, foot portion 10 is formed of a relatively soft rubber or plastic material impervious to salty and soft water, but which is sufficiently flexible to conform to the foot of a user. The side members 11 preferably are relatively stiff. Fin assembly 12 is normally formed of a stiff plastic material such as Teflon or nylon, for example. The upwardly closing check value elements 20A–C and 21A–C which flex about the bend lines may be formed of a material similar to the material of the fin portion 12, and should have a thickness such that they move easily between open and closed positions.

It now will be recognized that a new and improved swim fin assembly has been disclosed as having a bi-level construction that increases efficiency in use. While a preferred embodiment of the present invention has been illustrated in detail, it is apparent that modifications and adaptations will occur to those skilled in the art. However, it is to be expressly understood that such modifications and adaptations fall within the spirit and scope of the present invention as defined in the following claims.

What is claimed is:

1. A swim fin assembly comprising: a shoe having a toe portion; a multi-level fin assembly connected to said toe portion, each level of said assembly including a fin having an apparent area in the water; and automatic valve means associated with each of said levels for maximizing said apparent area during upward strokes of said fin assembly in the water and for minimizing said apparent area during downward strokes thereof.

2. The swim fin assembly of claim 1 wherein said fins are vertically spaced, and further including opposite side wall means for attaching said fins to one another.

3. The swim fin assembly of claim 2 wherein each of said fins includes a plurality of outwardly extending fin means having opposite side edges; and stiffener means for attaching adjacent ones of said side edges to one another.

4. The swim fin assembly of claim 3 wherein the connection between said fin assembly and said shoe is provided with weakened sections to allow limited flexure of said fin assembly relative to said shoe.

5. The swim fin assembly of claim 1 wherein each of said valve means comprises a generally rectangular member arranged for flexing movement about an axis that is transverse to a respective fin.

6. The swim fin assembly of claim 5 wherein each of said generally rectangular members extends outwardly of said axis a substantial distance to where its trailing edge is located at approximately the mid-point of the length of each of said fins.

7. A swim fin assembly comprising: a shoe having a toe portion; a fin assembly having upper and lower levels, each of said levels having a pair of fin members; means for connecting only said lower level to said toe portion; and substantially planar side wall means for attaching said upper and lower levels of fin members to one another in vertically spaced relationship.

8. The swim fin assembly of claim 7 wherein said fin assembly has a length that is approximately the same as the length of said shoe.

9. The swim fin assembly of claim 8 further including valve means associated with at least one of said levels of fin members for changing the apparent area during selected portions of a swimmer's kick.

* * * * *